US010993589B2

(12) United States Patent
Haralovich

(10) Patent No.: US 10,993,589 B2
(45) Date of Patent: May 4, 2021

(54) ROLLED PAPER DISPENSER

(71) Applicant: BLOOM-A-BOO LLC, Bloomington, IN (US)

(72) Inventor: Jennifer V. Haralovich, Bloomington, IN (US)

(73) Assignee: BLOOM-A-BOO LLC, Bloomington, IN (US)

( * ) Notice: Subject to any disclaimer, the term of this patent is extended or adjusted under 35 U.S.C. 154(b) by 0 days.

(21) Appl. No.: 16/534,495

(22) Filed: Aug. 7, 2019

(65) Prior Publication Data

US 2020/0046176 A1 Feb. 13, 2020

Related U.S. Application Data

(60) Provisional application No. 62/716,036, filed on Aug. 8, 2018.

(51) Int. Cl.
*A47K 10/22* (2006.01)
*A47K 10/38* (2006.01)

(52) U.S. Cl.
CPC ..... *A47K 10/22* (2013.01); *A47K 10/38* (2013.01)

(58) Field of Classification Search
CPC ..... A47K 10/22; A47K 10/38; A47K 10/3836
See application file for complete search history.

(56) References Cited

U.S. PATENT DOCUMENTS 1,226,453 A * 5/1917 Boyle ..... B65H 16/06 242/592
2,240,109 A * 4/1941 Baldwin ..... A47K 10/3836 242/571.5
2,240,629 A * 5/1941 Smith ..... A47K 10/3836 242/592
2,861,751 A * 11/1958 Sarro ..... A47K 10/38 242/594.3
5,653,403 A * 8/1997 Ritchey ..... A47K 10/3836 242/597.5
5,765,775 A * 6/1998 Keserica ..... A47K 10/38 242/597
D448,592 S * 10/2001 McBride ..... D6/522
7,306,185 B1 * 12/2007 Miller ..... A47K 10/3836 242/592
D784,043 S * 4/2017 Goodman ..... D6/546
10,334,997 B2 * 7/2019 Yocom ..... A47K 10/3836
10,512,369 B2 * 12/2019 Cuenca ..... A47K 10/3836
2005/0127229 A1 * 6/2005 Patterson ..... A47K 10/3836 242/422.5
2005/0247816 A1 * 11/2005 Feuerstein ..... A47K 10/3836 242/588.2
2008/0001019 A1 * 1/2008 Brown ..... A47K 10/3836 242/597.8

(Continued)

*Primary Examiner* — Michael E Gallion
(74) *Attorney, Agent, or Firm* — Brannon Sowers & Cracraft PC

(57) ABSTRACT

A rolled paper dispenser includes a base that has a rear surface, and a front surface. The rear surface is adapted to be mounted on wall. The rolled paper dispenser also includes a dispensing section that extends from the base at an angle away from the front surface of the base. The dispensing section is a generally elongated, flat, thin member and can include a securing section and an attachment section. The securing section extends from the dispensing section and defines an angle with the front surface of the base from about 25° to about 65°.

7 Claims, 3 Drawing Sheets

(56) References Cited

U.S. PATENT DOCUMENTS

| | | | | |
|---|---|---|---|---|
| 2011/0215187 | A1* | 9/2011 | Owurowa | A47K 10/38<br>242/550 |
| 2016/0270607 | A1* | 9/2016 | Zeng | A47K 10/22 |
| 2017/0360265 | A1* | 12/2017 | Yocom | A47K 10/3836 |

* cited by examiner

ROLLED PAPER DISPENSER

TECHNICAL FIELD

The present disclosure relates generally to devices for dispensing paper from a roll.

BACKGROUND

There are a great many different types of dispensers intended to hold and dispense sheets of paper from a roll, such as a toilet paper roll or a paper towel roll. These dispensers come in a variety of shapes and sizes, and can range from very simple to complex in both the way they operate and their ornamentation. Simple wire or rod hangers, vertical tubes, and wall-mounted spindles are well known and widely used. An example paper holder and dispensing system is set forth in U.S. Patent Application Publication No. 20110215187A1. While known strategies for holding and dispensing paper from a roll may be suitable in many contexts, there remains ample room for alternative strategies.

SUMMARY

In one aspect, a rolled paper dispenser includes a base having a top end and an oppositely disposed bottom end, a front surface and an oppositely disposed rear surface adapted to be mounted upon a wall. The rolled paper dispenser further includes a support member having a dispensing section structured to support a paper roll, and extending from the base and projecting at a first angle away from the front surface that is from about 25° to about 65°. The support member further includes an attachment section coupled to the base and oriented at a second angle relative to the dispensing section. The support member further includes a securing section forming a tip of the support member and extending at a third angle from the dispensing section toward the base to limit disengaging the paper roll from the dispensing section. The second angle is an obtuse angle and the third angle is an acute angle.

In another aspect, a paper holder includes a wall-mountable base portion, and a dispensing portion connected to, and extending from the wall-mountable base portion. The dispensing portion includes an elongated portion that extends away from the wall-mountable base portion in a direction opposed to the pull of gravity. The wall-mountable base portion and the elongated portion form an angle, opening upwardly, from about 25° to about 65°.

In still another aspect, a rolled paper dispenser includes a base having a top end and an oppositely disposed bottom end, a front surface and an oppositely disposed rear surface adapted to be mounted upon a wall. The rolled paper dispenser further includes a support member having a dispensing section structured to support a paper roll, and extending from the base and projecting at a first angle away from the front surface that is from about 25° to about 65°. The support member further includes a securing section forming a tip of the support member and extending at another angle from the dispensing section that opens in a direction of the base and oriented so as to limit disengaging the paper roll from the dispensing section.

DETAILED DESCRIPTION

Figure 5:
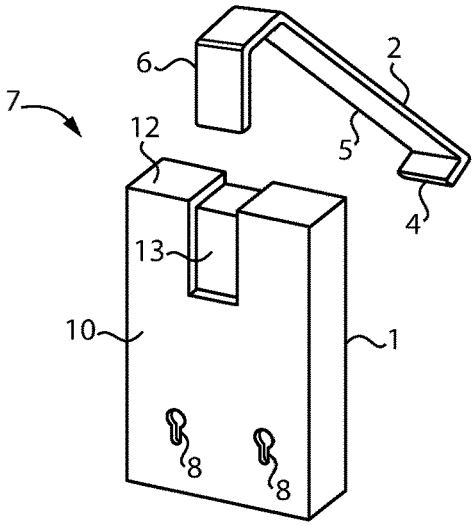
FIG. 5 is an exploded back perspective view of a rolled paper dispenser, according to a first embodiment.
Figure 6:
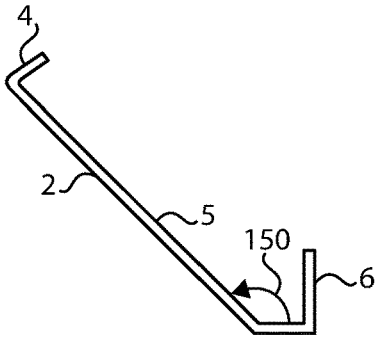
FIG. 6 is a side view of a support member for a rolled paper dispenser, according to a first embodiment.

Novel technology of a rolled paper dispenser 7 is shown in FIGS. 1-9. Dispenser 7 includes a base 1 that typically has a cross-sectional shape and contains a top end 11, an oppositely disposed bottom end 12, a front surface 9, an oppositely disposed rear surface 10, and a support member 2 structured to support a paper roll 3. The support member 2 is removably, reattachably connectable to the base 1. Paper roll 3 includes a roll of toilet paper, paper towels, hereinafter "paper roll 3", or other paper products stored on a roll. Base 1 may be rectangular, and typically formed predominately of a wood material, and support member 2 may typically be formed predominantly of a metal material such as aluminum but, as will be apparent from the discussion herein, either or both may be formed—in whole or in part—from any suitable material including, for instance, metal, ceramic, wood, glass, marble, or plastic materials. FIG. 6 shows the support member 2, which includes a dispensing section 5 and a securing section 4, and may further include an attachment section 6 for attaching support member to base 1. Dispensing section 5 may be a generally elongated, flat, thin member, although embodiments in which dispensing section 5 is curved, has rounded surfaces, or still other shapes, structures, or configurations are also contemplated. Support member 2 may include a one-piece elongate body of metal that has selected plastically deformed bends and dimensions to attain desired structural and functional properties as further discussed herein.

Material differences between embodiments will be discussed herein. Absent such discussion, different embodiments should generally be understood to be alike in structure and function. It will be appreciated that various embodiments of the dispenser 7 may have components with a variety of different designs or structures. For instance, base 1 could have any other shape or configuration, such as a circular shape, a different polygonal shape, or an abstract or ornamental shape, for instance. It will further be appreciated that certain embodiments may include elements from different embodiments disclosed herein. By way of example, in one embodiment, dispenser 7 could have both an oblong shape and beveled edges.

In the embodiment of FIGS. 1-6, dispensing section 5 is substantially straight and angled relative to front surface 9 of base at a first angle 100 from about 40° to about 50°. As used herein, the term "about" can be understood in the context of conventional rounding to a consistent number of significant digits. Accordingly, "about 40" might mean from 35-44, and so on. In other embodiments, dispensing section 5 may be angled to base 1 at a first angle 100 from about 25° to about 65°. Attachment section 6 may be oriented at an obtuse angle (a second angle) 150 relative to dispensing section 5 that is from about 115° to about 135°. Securing section 4 might also be substantially straight and angled at a third angle 110 from about 85° to about 95° relative to dispensing section 5. Angle 110 may be an acute angle, and angle 150 an obtuse angle in most embodiments. Securing section 4 could be oriented approximately normal to surface 9 in some embodiments. Securing section 4 may, based on its orientation, fit along the exposed outside surface of the end of paper roll 3 and trap paper roll 3 between securing section 4 and base 1 to prevent it from becoming disengaged during use. Securing section 4 is also typically angled by way of angle 110 toward base 1 to reduce likelihood of its being snagged by a user.

It can further be seen that placing paper roll 3 upon support member 2 causes an edge 120 of paper roll 3 to contact front surface 9. In this way, paper roll 3, and more specifically edge 120, generally remains in contact with front surface 9. This substantially continuous contact may create frictional resistance that prevents free unrolling and opposes the direction in which the sheets are being dispensed in a manner that may prevent accidental or otherwise undesirable dispensing from paper roll 3 without unduly encumbering normal use. As most types of paper rolls in common usage are pre-perforated, embodiments of dispenser 7 are contemplated in which the first angle 100 of dispensing section 5 relative to front surface 9 may be selected based on an amount of force necessary to tear the dispensed paper at the perforations, whilst still enabling unrolling.

In FIG. 5, support member 2 may be attached to base 1 by way of attachment section 6 through use of an adhesive such as glue, fasteners, or by any other suitable means. The bottom of base 12 may be structured with an engagement slot 13 created to lockingly accept attachment section 6, potentially using an interference fit or a slip fit, such that surfaces of attachment section 6 are substantially flush with the corresponding surfaces of base 1. In FIG. 5, dispenser 7 is shown in which support member 2 and base 1 are decoupled. As can be seen, a recessed section formed in a bottom end 12 and a rear surface 10 of base 1 may be sized and shaped to receive attachment section 6. Rear surface 10 may also include one or more installation members or features 8 for installing dispenser 7 in a desired location. For example, installation members 8 may be a recessed area formed in rear surface 10 such that dispenser 7 may be installed on a wall having fasteners positioned thereon. In this way, dispenser 7 may be installed such that rear surface 10 can be flush with the wall or other surface on which dispenser 7 is installed. Installation members 8 might be a hook, a screw, a wire, or any other device or structure suitable for installing dispenser 7 at a desired location. Base 1 might be structured to receive attachment section 6 such that attachment section 6 is not visible.

In another embodiment, support member 2 of dispenser 7 might not include an attachment section 6. In this embodiment, support member 2 may be integrally formed with base 1. For example, dispenser 7 might be manufactured to allow dispenser 7 to have a substantially uniform material composition. In other embodiments, base 1 and support member 2 may not be integrally formed and/or may have different material compositions. In such embodiments, support member 2 might be attached to front surface 9 of base 1 through use of an adhesive, fasteners, or any other suitable attachment strategy, potentially within a recess.

Figure 7:
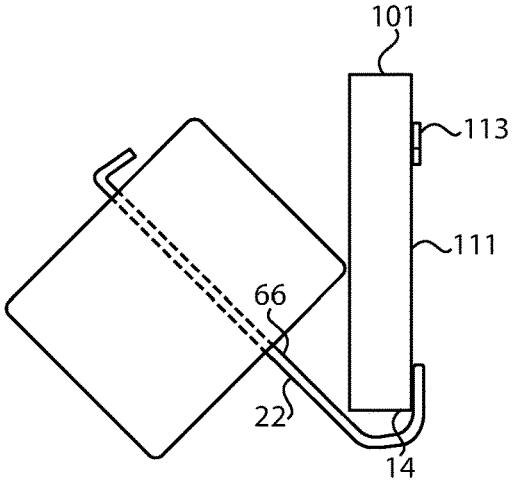
FIG. 7 is a side view of a rolled paper dispenser supporting a paper roll, according to a second embodiment.

In FIG. 7, an attachment section 66 of a support member 22 may have a curved, swooping shape that extends below a bottom end 14 before curving upwards. In such an embodiment, attachment section 66 may not be flush with a back surface 111 of base 101. Installation members 113 may be structured to project from rear surface 111 a similar distance that attachment section 66 projects from rear surface 111. A top end is shown at 101

Figure 8:
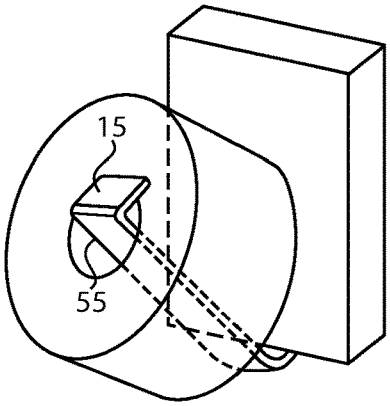
FIG. 8 is a front perspective view of a rolled paper dispenser, according to a second embodiment.
Figure 9:
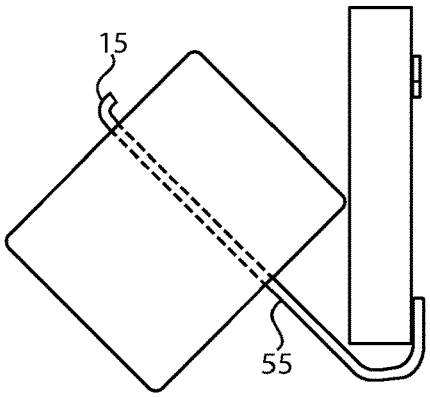
FIG. 9 is a side view of a rolled paper dispenser, according to a third embodiment.

In FIGS. 8 and 9, the transition between a securing section 15 and a dispensing section 55 of a support member 2 may have a curved shape.

INDUSTRIAL APPLICABILITY

Referring to the drawings generally, it will be appreciated by most that toilet paper and other rolled paper that is dispensed for personal hygiene, cleaning activities, or still other purposes can often freely and uncontrollably unroll. Pets and playful children can often ruin a roll of such paper, or require a person to tediously reroll the paper upon its spool. Conventional paper dispensers are typically either mounted upon a horizontal spindle or the like which allows free and unrestricted unrolling, or sometimes vertically oriented, equipped with an anti-rotation cover that sits upon the roll, or simply placed on a surface and not supported for rotation at all. Waste of rolled paper is generally annoying, and potentially expensive.

Figure 1:
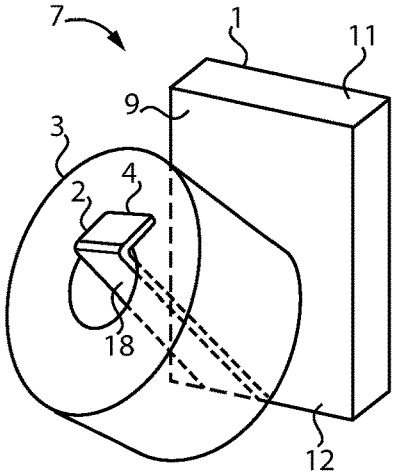
FIG. 1 is a perspective front view of a rolled paper dispenser supporting a paper roll, according to a first embodiment.
Figure 2:
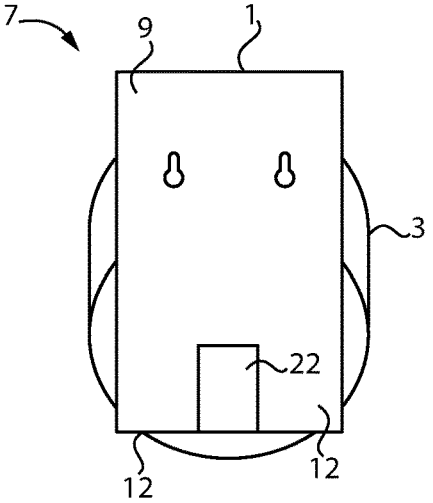
FIG. 2 is a back view of a rolled paper dispenser, according to a first embodiment.
Figure 3:
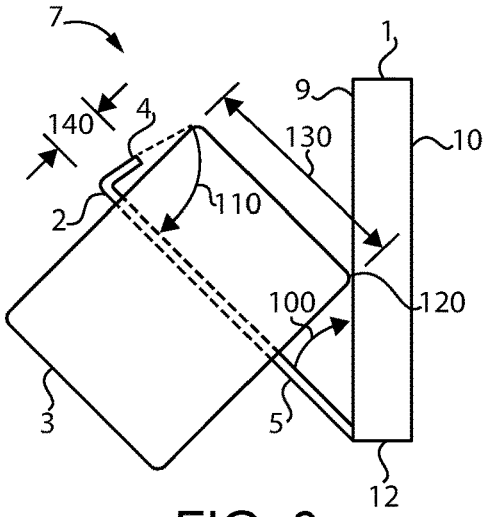
FIG. 3 is a side view of a rolled paper dispenser, according to a first embodiment.
Figure 4:
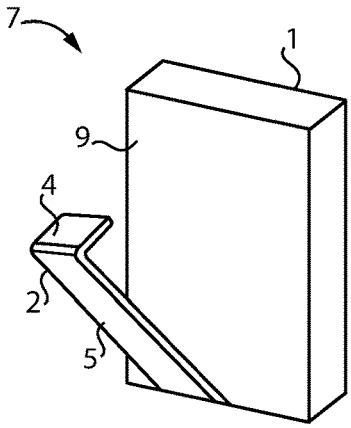
FIG. 4 is a front perspective view of a rolled paper dispenser without paper roll, according to a first embodiment.

The present disclosure provides a diagonally oriented paper roll support that employs mild frictional interaction to give the paper roll some resistance to unrolling. Referring back to FIG. 3, it will be recalled that angle 100 assists in providing this frictional interaction as the weight of paper roll 3 will tend to cause paper roll 3 to be seated against from surface 9. Angle 110 and length 140 of securing section 4 meanwhile enables rolled paper to be slipped onto dispensing section 5 and passed over securing section 4. Securing section 4 may form a tip of dispensing section 5, and is sized such that a conventional toilet paper tube can be slipped into place, yet prevented from being pulled off. A projection distance 140 is shown in FIG. 3 and might be from about 2 centimeters to about 5 centimeters. Another distance is shown at 130, and may be about 9 centimeters to about 14 centimeters, corresponding generally to an axial length of a conventional and standard toilet paper roll and its core tube. Distance 130 may be understood as a distance from an inside surface of securing section 4 in a straight line to surface 9, and oriented parallel to dispensing section 5. A full length of dispensing section 5 from front surface 9 to securing section 4 might be from about 12 centimeters to about 20 centimeters. It will be appreciated that the disclosed dimensional and angular attributes herein work cooperatively to ensure that a paper roll can be supported and capable of being rotated without unduly restricting rotation and requiring or causing paper to be accidently torn. The angular orientation of the rolled paper when installed for service further provides a pleasing aesthetic.

The present description is for illustrative purposes only and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different devices and assemblies having a variety of different structures than those specifically described herein. Other aspects, features, and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

The invention claimed is:

1. A rolled paper dispenser comprising:

a base having a top end and an oppositely disposed bottom end, a front surface and an oppositely disposed rear surface adapted to be mounted upon a wall;

a support member including a dispensing section structured to support a paper roll, and extending from the base and projecting at a first angle away from the front surface that is from about 25° to about 65°;

the support member further including an attachment section coupled to the base and oriented at a second angle relative to the dispensing section;

the support member further including a securing section forming a tip of the support member and extending at a third angle from the dispensing section toward the base to limit disengaging the paper roll from the dispensing section;

the second angle is an obtuse angle and the third angle is an acute angle.

2. The roller paper dispenser of claim 1 wherein the support member includes a one-piece metal body that is elongate, thin, and flat, and the second angle and the third angle are formed by plastically deformed bends of the elongate metal body.

3. The rolled paper dispenser of claim 1 wherein the base has a slot formed therein, and the attachment section is received flush within the slot.

4. The rolled paper dispenser of claim 1 wherein the base is formed from a structural material selected from the group comprising metal, ceramic, wood, glass, marble, plastic, or combination thereof.

5. The rolled paper dispenser of claim 1 wherein the rear surface includes an installation member disposed opposite the dispensing section.

6. The rolled paper dispenser of claim 1 wherein the first angle is from about 40° to about 50°.

7. The rolled paper dispenser of claim 1 further comprising a standard roll of paper supported upon the dispensing section and trapped between the securing section and the base.

* * * * *